US010490028B1

(12) United States Patent
Malizia

(10) Patent No.: US 10,490,028 B1
(45) Date of Patent: Nov. 26, 2019

(54) EVENT BOX POOL MARKETPLACE SYSTEMS

(71) Applicant: GRIDS OF SKILL LLC, Rockville Centre, NY (US)

(72) Inventor: Joseph Francis Malizia, Rockville Centre, NY (US)

(73) Assignee: GRIDS OF SKILL LLC, Rockville Centre, NY (US)

( * ) Notice: Subject to any disclaimer, the term of this patent is extended or adjusted under 35 U.S.C. 154(b) by 0 days.

(21) Appl. No.: 16/200,285

(22) Filed: Nov. 26, 2018

(51) Int. Cl.
*G07F 17/32* (2006.01)
*G06Q 30/08* (2012.01)
*G06Q 50/34* (2012.01)

(52) U.S. Cl.
CPC ..... *G07F 17/3288* (2013.01); *G06Q 30/08* (2013.01); *G06Q 50/34* (2013.01); *G07F 17/326* (2013.01); *G07F 17/3244* (2013.01); *G07F 17/3295* (2013.01)

(58) Field of Classification Search
CPC ..... G07F 17/3288; G07F 17/329
See application file for complete search history.

(56) References Cited

U.S. PATENT DOCUMENTS

| | | | | |
|---|---|---|---|---|
| 8,764,558 | B2 | 7/2014 | Amaitis et al. | |
| 8,827,787 | B2 | 9/2014 | Smith et al. | |
| 9,430,909 | B2 | 8/2016 | Shore et al. | |
| 9,704,338 | B2 | 7/2017 | Marantelli | |
| 2011/0065494 | A1 | 3/2011 | Kennedy et al. | |
| 2011/0281620 | A1 | 11/2011 | Hays | |
| 2012/0058815 | A1 | 3/2012 | Ivanov | |
| 2014/0113713 | A1 | 4/2014 | Fontaine et al. | |
| 2014/0274347 | A1* | 9/2014 | Alexander | G07F 17/3276 463/26 |
| 2015/0105142 | A1 | 4/2015 | Amaitis et al. | |
| 2016/0210815 | A1* | 7/2016 | Holt | G07F 17/3244 |
| 2017/0046905 | A1 | 2/2017 | Ramos et al. | |
| 2017/0046922 | A1 | 2/2017 | Tharp | |
| 2017/0221308 | A1 | 8/2017 | Lakhotia | |
| 2017/0294074 | A1 | 10/2017 | Lovell, Sr. | |
| 2018/0012454 | A1 | 1/2018 | Thirumaleshwar | |
| 2018/0068529 | A1 | 3/2018 | Delekta et al. | |
| 2018/0082541 | A1 | 3/2018 | Palermo et al. | |

OTHER PUBLICATIONS

"Five ways to invigorate your super bowl office betting pool," by Brian Beers, Published Jan. 28, 2013. Source: https://www.cnbc.com/id/46224692 (Year: 2013).*

"Aaron Brown's Super Bowl XLIX Squares," by Aaron Brown, Published Jan. 26, 2015. Source://http://www.minyanville.com/business-news/editors-pick/articles/super-bowl-squares-aaron-brown-super/1/26/2015/id/55944 (Year: 2015).*

"How to PLay & Win at Super Bowl Squares," by Lee Foster, Published Jan. 21, 2015. source: https://web.archive.org/20150311234657/https://www.picks.org/nfl/super-bowl-squares (Year: 2015).*

"Super Bowl office pool games & ideas," by Eugene Feygin, Published Apr. 28, 2017. source: https://www.quill.com/blog/lifestyle/super-bowl-office-pool-games-ideas.html (Year: 2017).*

"The Legal Risk of Super Bowl Squares Pools," by Marc Edelman, Published Jan. 31, 2014. source: https://www.forbes.com/sites/marcedelman/2014/01/31/the-legal-risk-of-super-bowl-squares-pools/#6644b6b61bb5 (Year: 2014).*

Cerino, M., Betting Exchange Smarkets Around Sports Wagering Operators Eyeing US, Legal Sports Report (Apr. 12, 2018).

* cited by examiner

*Primary Examiner* — Steven J Hylinski
(74) *Attorney, Agent, or Firm* — Giaccio LLC; Anthony Giaccio

(57) ABSTRACT

Disclosed is an event marketplace system that allows box pool users to use their skills to increase their chance of winning the entire box pool, and/or to use their skills to enhance their gains even if their box does not win the entire box pool, and/or use their skill to limit or hedge their loss from participating in the pool.

39 Claims, No Drawings

EVENT BOX POOL MARKETPLACE SYSTEMS

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIALS SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCLOSURES BY THE INVENTOR OR A JOINT INVENTOR

Not applicable.

BACKGROUND OF THE INVENTION

Field of Invention

This invention generally relates to an event marketplace system that allows box pool users to use their skills to increase their chance of winning the entire box pool, and/or to use their skills to enhance their gains even if their box does not win the entire box pool, and/or use their skill to limit or hedge their loss from participating in the pool.

Description of Related Art

A box pool (also referred to as "squares", and commonly used during Football Super Bowl) is a form of contest known in the prior art that gives participants an equal chance to win. For a given event, participants can purchase one or more boxes from a pool of boxes. Each box has an equal chance of winning. For example, if there are 100 boxes, a participant has 1 chance in 100 of winning. The only way for a participant to change the probability of winning is to purchase additional boxes. If a participant buys 10 boxes of the 100 boxes, the odds are now 1 in 10 of winning. Even so, in both circumstances the probability of winning involves only chance and not skill.

U.S. Patent Application No. 2017/0221308 discloses a pool betting system that allows betting to take place before an event, as in a traditional pool and provides for a secondary market in bets during the event, whereby players may bet on the highest scoring batsman in a game of cricket, for example. Bets are placed and the pool is closed before play begins, but during the game players can change their position by buying and selling bets from other players. This allows in-play participation without adversely affecting the interests of non-participating players.

U.S. Patent Application No. 2011/0065494 discloses a system and method for purchasing and trading wagering shares representing one of two possible outcomes of an event before and during the event. During each of one or more stoppages of the event, the price of the wagering shares representing a first outcome of the event and the price of the wagering shares representing a second outcome of the event are adjusted according to a progression of the event and to market supply and demand for the wagering shares. Purchasing, by bettors, of the wagering shares prior to the start of the event and trading, between the bettors, of the wagering shares prior to the start of the event and during each of the stoppages of the event is facilitated by an exchange.

U.S. Pat. No. 8,764,558 discloses a method of managing bets that includes receiving first types of bets and second types of bets. Each first type of bet comprises a bet that the number of units earned by a participant in a plurality of events will fall within a first range of numbers. Each second type of bet comprises a bet that the number of units earned by the participant over a course of a plurality of events will fall within a second range of numbers. The total number of units earned by the participant is determined based on the positioning of the participant in each event. The method includes determining whether the first or second type of bets are winning bets. A betting pool is determined based on the total amounts associated with the first and second types of bets. A payout is determined based on the betting pool and the total amounts of the winning bets.

U.S. Patent Application No. 2012/0058815 discloses a dynamic betting valuator system, method and computer program product which enables bettors to make, withdraw, and increase/decrease the stake of bets on the outcome of particular events at any time. Specialized stock and stock pricing mechanisms are applied in a betting context to create the dynamic betting valuator. The systems, methods and computer program product treat the placing of a bet by a bettor as a purchase of shares in that particular outcome for the particular event. Each potential outcome for a given event has an associated "outcome stock" in which players are buying shares. Each bet amount on a certain outcome is converted into a number of shares of that outcome stock. A bettor may change his bet, i.e. have the computer program product sell shares in a particular outcome stock, prior to the event taking place, potentially making a profit from the bet despite the outcome not yet having been determined.

U.S. Patent Application No. 2014/0113713 discloses a system that generates multiple presentations, or game play opportunities, based upon a single defined value set relating to a wager produced by the outcome of concurrent, multi-venue, multi-event, multi-outcome horse racing pari-mutuel wager. Once the wager has been defined, the events comprising the dataset of wagers are arranged sequentially. One or more random number generators are utilized to distribute the dataset elements as well as corresponding numbers, symbols or images in a random rather than sequential fashion thereby resulting in multiple unique game play opportunities.

U.S. Patent Application No. 2017/0294074 discloses a game of chance that allows for an outcome determined by the actions of a player. The game of chance comprising a layout defining plural cells. A player selects a number of winning indicia and a pre-determined winning order for the winning indicia to be revealed. A first portion of the cells each have a winning indicia contained therein, and a remaining portion of the cells each have a non-winning indicia contained therein. The winning and non-winning indicia are initially concealed to a player and are selectively revealable by the player. The player may select a limited number of cells to reveal indicia contained therein. An object of the game is to maximize a number of winning indicia revealed by the player.

U.S. Patent Application No. 2018/0082541 discloses a method of receiving a skill level input specifying a first skill level from a set of different skill levels, and in response to the skill level input, placing the gaming machine in a first state. Each respective skill level in the set of different skill levels is correlated to a different respective proportion between a player skill-dependent component and random component of the wagering game. Thus placing the gaming machine in the first state has the effect of setting that skill-dependent to random proportion to a desired value. After placing the gaming machine in the first state, the method includes receiving player inputs for which a prize may ultimately be awarded. This prize is determined by (i) any player inputs included in the player input set for the player skill-dependent component and (ii) the random component in an award proportion based on the desired value.

U.S. Patent Application No. 2017/0046922 discloses a system, method, and an apparatus for playing a betting game in conjunction with the play of a sporting event, wherein the apparatus may include a system and/or a computer program product for playing a better game, such as roulette, which may be played in combination with watching a sporting event, such as cricket. Related methods, systems, apparatus, and/or articles are also described.

U.S. Patent Application No. 2015/0105142 discloses a system wherein a user may purchase an option to cancel a wager in exchange for a refund amount. In purchasing the option, the user may select an exercise time from a plurality of exercise times, each exercise time having an associated price, which price may be the price of the option. The refund amount associated with each exercise time may be the same amount. Responsive to a user exercising a purchased option, a determination may be made as to whether the time of exercise is at least prior to the selected exercise time. If so, the wager may be canceled in exchange for the refund amount.

U.S. Patent Application No. 2018/0012454 discloses a gaming system and method providing a wagering game including a skill-based game having a player-selected difficulty level and duration, wherein the skill-based game contributes to the average expected payback percentage of the wagering game such that the average expected payback percentage of the wagering game can vary within a predetermined range from player-to-player based on the players' skill levels. The gaming system enables each player to obtain the AEP % WAGERING GAME at or near the upper end of the predetermined range, regardless of the player's skill level.

U.S. Pat. No. 8,827,787 discloses gaming devices, gaming systems, methods of conducting wagering games, and computer programs for executing wagering games are disclosed. A gaming system for playing a wagering game is disclosed which includes one or more processors and one or more memory devices storing instructions that, when executed by at least one of the processors, cause the gaming system to: receive a wager to play the wagering game; direct a display device to display a randomly determined outcome of a base game of the wagering game; in response to a triggering event, initiate play of a non-skill-based game feature and, further in response to receiving a player selection of a skill-based game feature, initiate play of the skill-based game feature; determine an award value for the skill-based game feature; determine an award value for the non-skill-based game feature; and, award to the player only the higher of the two award values.

U.S. Patent Application No. 2017/0046905 discloses a gaming system which provides a player the opportunity to win one or more awards based on the final value of an increasing award pool. Such opportunities may take the form of a player placed side bet on a predicted final amount of an award pool which increases different amounts at different points in time. Such opportunities may take the form of enabling a player to make one or more inputs regarding a predicted final amount of an award pool which increases different amounts at different points in time. If the player's predictive value of the final amount of the award pool corresponds with the actual value of the final amount of the award pool, the gaming system provides one or more awards to the player.

U.S. Patent Application No. 2011/0281620 discloses a substantially real-time status of an athletic competition may be accessed while it is being broadcast to a user on user equipment. An upcoming event of a pre-determined type in the athletic competition may be detected based on the accessed real-time status. A wagering opportunity may be generated based on the type of the event, where the wagering opportunity may related to an outcome of the upcoming event. The wagering opportunity may be presented to the user via the user equipment.

U.S. Patent Application No. 2018/0068529 discloses a gaming machine for providing a skill-based wagering game to a player is described herein. The gaming machine includes a controller programmed to display the skill-based wagering game on a display device, receive a signal indicating a wager being received from the player, and initiate the skill-based wagering game. The controller determines a player skill level value associated with the player based on player skill operations received during game play and accesses RTP value data to determine an RTP value based on the determined player skill level value and the received wager amount. The controller generates a plurality of primary awards as a function of the determined RTP value, displays a primary award selection screen to select a primary award from the plurality of primary awards, and adjust the credit balance based on the player selected primary award.

An article by Cerino, M., "Betting Exchange Smarkets Among Sports Wagering Operators Eyeing US, Legal Sports Report (Apr. 12, 2018) discloses interest expressed by European business to expand their online and mobile wagering to the United States.

U.S. Pat. No. 9,430,909 discloses a location based wagering method and systems, wherein an online wagering service can be invoked via a mobile device. A determination can be then made regarding the location of the mobile device and a jurisdiction (e.g., state, county, city, etc.) associated with that location. The mobile device and hence a user can be authorized to access the online wagering service based on the location of the mobile device. Based on the location, it can also be determined if use of the online wagering service is allowed in the jurisdiction along with prescribed limitations of use in that jurisdiction. Wagering options are then presented via the mobile device, which conform to the laws and/or regulations of the jurisdiction.

U.S. Pat. No. 9,704,338 discloses a system, method and apparatus for a betting product where players make selections in one or more different events. Players who are in contention to win may be offered an opportunity to sell their tickets, in whole or in part, in response to a full or partial buy-out offer made at any time prior to completion of a wagering event.

Definitions

"Chance" is "something that happens unpredictably without discernible human intention or observable cause" and "the possibility of a particular outcome in an uncertain situation." (Merriam-Webster Dictionary 2018)

A "game of chance" is "a game (such as a dice game) in which chance rather than skill determines the outcome." (Merriam-Webster Dictionary 2018)

A "game of skill" is "a game (as chess) in which skill rather than chance determines the outcome." (Merriam-Webster Dictionary 2018)

"Odds" is "(1) the probability that one thing is so or will happen rather than another (2) the ratio of the probability of one event to that of an alternative event." (Merriam-Webster Dictionary 2018)

"Probability" is "(1) the ratio of the number of outcomes in an exhaustive set of equally likely outcomes that produce a given event to the total number of possible outcomes (2) the chance that a given event will occur." (Merriam-Webster Dictionary 2018)

BRIEF SUMMARY OF THE INVENTION

The present invention relates a computer-implemented method of conducting a box pool marketplace having at least one processor in communication with one or more user input devices comprising the steps of creating one or more box pools with boxes for one or more events that are created by the processor and communicated to the one or more user input devices, wherein each created box pool comprises a grid of boxes with no assigned values; communicating from the processor to the one or more user input devices at a pre-determined first time the created one or more box pool grids to users to purchase one or more boxes with no assigned values; receiving by the processor from the one or more user input devices purchases by users of the one or more boxes with no assigned values; closing by the processor user access to the box pool grid for a specific event at a pre-determined second time; assigning by the processor of values to the purchased boxes of the closed box pool grid; opening user access to the box pool grid of purchased boxes with assigned values at a pre-determined third time; receiving and processing by the processor of transaction activity between users, wherein users have access the assigned values of the purchased boxes and have access to user information of each owner of each purchased box; effectuating by the processor of user transactions; and reconciling and transmitting net gains and net losses of user transactions to the users. The present invention further relates to a computer-implemented method of conducting a box pool marketplace, wherein the pre-determined time of communicating to the one or more user devices one or more box pool grids of boxes with no assigned values is before the start of the event or during the event, wherein the pre-determined time of opening user access to the box pool grid of purchased boxes with assigned values is before the start of the event or during the event, wherein net gains and losses of user transactions are transmitted to users at the end of the event, and wherein the transaction activity between users comprises one or more of a box offer for sale, a box sale, a box offer to purchase, a box purchase, a box offer to trade, a box trade, a box auction, a box auction bid, each activity in whole or in part, and any combination of such activities. The present invention further relates to a computer-implemented method of conducting a box pool marketplace, wherein two or more box pool grids are created by the processor and communicated to the one or more user input devices and wherein the transaction activity is received and processed by the processor involving boxes from two or more box pool grids, wherein receiving and processing by the processor of transaction activity is between a user who purchased one or more boxes with no assigned value and a second user who did not purchase one or more boxes with no assigned value, wherein the two or more box pool grids are for the same event, and wherein the two or more box pool grids are for different events. The present invention further relates to a computer-implemented method of conducting a box pool marketplace, wherein the grid of boxes comprises a two dimensional grid of boxes with an x axis and a y axis, wherein the grid of boxes comprises a three dimensional grid of boxes with an x axis, a y axis, and a z axis, and wherein the one or more box pools comprising a grid of boxes comprises two or more grids of boxes, wherein at least one grid of boxes is a two dimensional grid of boxes and at least one grid of boxes is a three dimensional grid of boxes.

The present invention further relates to a computer-implemented method of conducting a box pool marketplace having at least one processor in communication with one or more user input devices comprising the steps of creating one or more box pools with boxes for one or more events that are created by the processor and communicated to the one or more user input devices, wherein each created box pool comprises a grid of boxes with assigned values, wherein each box with an assigned value is assigned a price and offered for sale to users at the assigned price; communicating from the processor to the one or more user input devices at a pre-determined first time the created one or more box pool grids to users to purchase one or more boxes with assigned values at the assigned price per box for the event; receiving by the processor from the one or more input devices purchases by users of the one or more boxes with assigned values at the assigned price per box; opening user access to the box pool grid of purchased boxes with assigned values at a pre-determined second time; receiving and processing by the processor of transaction activity between users, wherein users have access to the assigned values of the purchased boxes; effectuating by the processor of user transactions; and reconciling and transmitting net gains and net losses of user transactions to the users. The present invention further relates to a computer-implemented method of conducting a box pool marketplace, wherein the pre-determined time of communicating to the one or more user devices one or more box pool grids of boxes with assigned values is before the start of the event or during the event, and wherein the pre-determined time of opening user access to the box pool grid of purchased boxes with assigned values is before the start of the event or during the event. The present invention further relates to a computer-implemented method of conducting a box pool marketplace, wherein the transaction activity between users comprises one or more of a box offer for sale, a box sale, a box offer to purchase, a box purchase, a box offer to trade, a box trade, a box auction, a box auction bid, each activity in whole or in part, and any combination of such activities. The present invention further relates to a computer-implemented method of conducting a box pool marketplace, wherein the processor assigns the same price to each box within the same grid of boxes with assigned values. The present invention further relates to a computer-implemented method of conducting a box pool marketplace, wherein the processor determines the price of each box within the same grid of boxes with assigned values based on the assigned value of each box and assigns a probability based price to each box within the same grid of boxes with assigned values.

The present invention further relates to a box pool marketplace system, the system comprising at least one system control server; and at least one central server with memory having instructions stored thereon, wherein the central server is configured to communicate with the at least one system control server and one or more user input devices, and wherein the system control server is configured to (a) initialize one or more box pools for one or more events, (b) process box purchases by users of boxes from one or more box pools and for one or more events, (c) communicate box pool information to users from one or more box pools and for one or more events, (d) receive and process box pool transaction activity between users from one or more box pools and for one or more events, (e) effectuate box pool transactions between users from one or more box pools and from one or more events, and (f) reconcile and transmit net gains and net losses of user transactions to users. The present invention further relates to a box pool marketplace system, wherein the transaction activity comprises one or more of a box offer for sale, a box sale, a box offer to purchase, a box purchase, a box offer to trade, a box trade, a box auction, a box auction bid, each activity in whole or in part, and any combination of such activities. The present invention further relates to a box pool marketplace system, wherein the central server further comprises a user to user communication system to facilitate transaction activity between users.

The present invention further relates to a kiosk for conducting a box pool marketplace system comprising a user input interface connected to a local server within the kiosk and a user display connected to the local server within the kiosk, wherein the user display provides an interface for the user to view box pool marketplace activities, wherein the local server within the kiosk is configured to communicate with a central server having a system control server, and wherein the system control server is configured to (a) initialize one or more box pools, (b) receive box purchases from user accounts, (c) process transaction activities by and between users, (d) effectuate transactions between user accounts, and (e) reconcile and transmit gains and losses between users in the one or more box pools. The present invention further relates to a kiosk for conducting a box pool marketplace system, wherein the user input interface is connected wirelessly to the local server within the kiosk, wherein the user input interface is selected from the group consisting of a laptop computer, a tablet computer, a desktop computer, a keyboard, a portable phone, and an electronic watch, wherein the kiosk is selected from the group consisting of a parking lot display screen, an electronic billboard, a stadium jumbotron, an arcade machine, a casino machine, a shopping mall booth device, a laptop computer, a tablet computer, a desktop computer, a keyboard, a portable phone, and an electronic watch, and wherein the kiosk is a stadium jumbotron and the user input interface is connected to one or more users' seats in the stadium.

Other features and aspects of the present invention will become more fully apparent from the following detailed description of some example embodiments and the appended claims.

PREFERRED EMBODIMENTS OF THE INVENTION

The inventor has recognized a need for a new way of playing box pools that changes the game from a game of chance to a game of skill and that provides a new opportunity for users to improve both their chance of winning the entire box pool and/or at the same time to improve their gains or reduce losses even without winning the entire box pool, and/or use their skill to limit or hedge losses from participating in the pool.

The following game of chance, known as a box pool, is known in the art:

First, in advance of an event such as a football game, an organizer creates a grid of boxes with an x and a y axis (e.g., a grid with 10 rows and 10 columns).

Second, the organizer sells some or all of the boxes in the grid for a set price per box to participants.

Third, after the boxes are sold to participants, the organizer (in the case of a football pool) assigns the numbers 0-9 in random order to each column of the grid along an x axis of the grid and assigns the numbers 0-9 in random order to each row along a y axis of the grid.

Fourth, the organizer assigns the x axis numbers to a first team and assigns the y axis numbers to a second team.

Fifth, at the outset of the game, the organizer closes the grid so that no changes can be made to the assignment of boxes to each participant, no changes can be made to the assignment of column and row numbers, and no changes can be made to the assignment of teams to each axis.

Sixth, at the conclusion of pre-set intervals, the winner is identified by selecting the single digit number in the "one's" decimal place of the first team final score (e.g., "4" in the score "24") and the single digit number in the "one's" decimal place of the second team final score (e.g., "6" in the score "36"), which identifies the winner who is the participant who happened to purchase the single winning box (in this example, the box in column 4 and row 6) of the grid.

The chance of winning this traditional box pool game is 1 in 100. And, the chance of losing this traditional box pool game is 99 in 100.

In a first non-limiting embodiment of the invention, the present invention relates to a marketplace of user transactions allowing users to sell, buy, and trade box pool boxes with other users before the start of an event (a) to allow participants to offer to trade and trade already purchased boxes in whole or in part, (b) to allow participants to offer to sell and sell boxes in whole or in part, and (c) to allow participants to offer to buy and buy boxes in whole or in part, and any combination of these activities. Trades can be made in kind (box-for-box, box-for-boxes, or boxes-for-box), for cash (box-for-cash, boxes-for-cash, or cash-for-box), or any combination thereof. These new marketplace activities convert the traditional game of chance to a game of skill.

Once one or more box pools are created, participants purchase one or more boxes of a grid for an event before values are assigned to the boxes. After the organizer assigns values to the boxes, then the organizer publishes the grid that remains closed until the end of the event. Participants using the new box pool marketplace can change their likelihood of winning the entire box pool and enhance their probability of gains even if their box does not win the entire box pool because participants now have an opportunity to offer to sell and sell, offer to buy and buy, and offer to trade and trade boxes after a value is assigned to their box. Buying, selling, and/or trading boxes can be done by way of exchanging cash, in-kind compensation (e.g., swapping), or any combination of the same before and during an event. In a non-limiting alternative embodiment of the invention, the marketplace opens and closes before the start of the event. In another non-limiting alternative embodiment of the invention, the marketplace opens during the event.

This new process allows participants to invest, divest, increase or decrease risk, and hedge all to enhance their individual outcome. The chance of winning is no longer just 1 in 100. If the participant chooses not to participate in the box pool marketplace, then the chance of winning remains 1 in 100. However, if instead the participant chooses to participate in the box pool marketplace, then the participant can alter their individual chance of winning the entire box pool and can alter their individual gains or reduce their losses while playing the box pool marketplace by using their knowledge of the particular event and by using their skills to sell, buy, and trade boxes, and/or any combination thereof.

This event marketplace system thus allows a participant an opportunity to increase their likelihood of winning the entire box pool for that event because the participant has the opportunity to buy another participant's box with an assigned value that is more likely to win the entire box pool. This event marketplace system also allows a participant to recover the cost of their box purchase or to make substantial gains using their skills to trade, buy, and sell their box based on the changing circumstances of the event. For example, if a first participant is assigned a box with little perceived chance of winning the entire box pool, then that first participant could try to trade or buy a box from a second participant with a box perceived to have a greater chance of winning. If during the course of the event the circumstances change, then other participants may offer substantial sums of cash to the first participant to purchase the first participant's box. If the first participant sells the first participant's box, then the first participant will have a gain even though the first participant's box may not ultimately win the entire box pool.

A participant would be able to use their skills to change their odds of winning in more ways than purchasing additional boxes at the outset. In one instance, if a user is not satisfied with their assigned values, there are a couple of ways to change their odds of winning. Prior to the start of the event, the participant is able to scan the landscape of the grid that the user is currently a part of. In non-limiting alternative embodiments, the participant can also scan the landscape of other box values of other boxes in other grids for the same or different events. The participant is able to offer to sell and sell the participant's box, is able to offer to buy and buy another participant's box, and is able to offer to trade and trade the participant's box with another participant for the other participant's box, and any combination of these activities in whole or in part. Another participant is able to offer to buy and buy the participant's box, is able to offer to sell and sell the other participant's own box to the participant, and is able to offer to trade and trade the other participant's own box, or boxes, in whole or in part, and in any combination of these activities in whole or in part. In non-limiting alternative embodiments, a participant is also able to engage in these activities with another participant who owns a box in the same grid, in a different grid for the same event, or in a different grid for a different event. In non-limiting alternative embodiments, a participant is also able to participate in the box pool marketplace to offer to buy and buy any box in any grid for any event without having to first purchase an initial box that has not been assigned a value. These are ways that a participant can increase their chance of winning the entire box pool, and generate value for themselves without owning the box with the winning value for the entire box pool.

In this first non-limiting alternative embodiment of the present invention, at least one processor of a control server is configured to generate a grid of boxes for an event. The grid can comprise any number of boxes. The central server is configured to communicate by physically or wirelessly with a local server connected to a user input interface. Users are allowed to purchase a box within a pre-determined time period. The local server is configured to communicate the user purchase to the central server. After the purchase time closes, the system control server assigns values to each column and row to the system control server of the central server, and, as a result, each box of the grid is assigned a unique combined column and row value. After the values are assigned to the boxes and before the event begins, the central server communicates the grid of boxes from the system control server to the local server of the users and the grid of boxes is opened to a marketplace.

In the marketplace, the users have a user input interface and have a user display to see the landscape of the grid and other information about the event and about the activities of and information about the other users who purchased a box (and in a non-limiting alternative embodiment, the user display shows the activities of and information about users who have not purchased a box) within that grid for the specific event (and in a non-limiting alternative embodiment, the user display shows the activities of and information about users of grids for other events). Users can negotiate to buy, sell, and trade with other users before the event starts and can buy, sell, and trade with other users before the event starts. The offers to sell, offers to buy, and offers to trade are input by the user using the user input interface and communicated by the local server to the central server and processed by the system control server.

The system control server, in addition to being configured to initialize one or more box pools, is also configured to receive user transactions including offers to sell, offers to buy, and offers to trade received from local servers, configured to process user transactions including trade requests received from box purchase user accounts, configured to effectuate user transactions including trades between two or more users, configured to transmit payment to the winning user's account, configured to receive and process event information, and configured to reconcile and transmit gains and losses between users in the box pool at one or more pre-determined times and/or on a continuous basis (for example in real time), before the event starts, during the event, at the end of the event, or after the end of the event, and any combination of times.

The central server is also configured to allow users to communicate with each other before the event starts using a communication system apart from the transaction activity of offering to sell and selling, offering to buy and buying, and offering to trade and trading system.

In this first non-limiting embodiment, each user has the option to either refrain from buying, selling, or trading boxes with other users or can buy, sell, or trade boxes with other users in line with the preference of the particular user for each unique combined assigned value of each box before the event starts. In addition, publicly available historical data may drive interest to a particular box or boxes with unique assigned values.

Once the event starts, according to this first embodiment of the invention, the marketplace closes. The results at the end of the event, or at pre-determined time intervals during the event, determine the winner and payout amounts to the winner, along with reconciled gains and losses, are determined based on the transaction activities made pre-event and transmitted to the appropriate user accounts.

Every person who wants to participate in this computer-implemented event marketplace system must have a user account so that the system control server can process all final transactions. Initially, each user must create a user account and provide private account information, such as the user's name, contact information, credit card information, banking information, payment processor information (VISA, Mastercard, American Express, PayPal, etc.), e-mail address, telephone number, GPS location, as well as public account information, such as the user's username, user's code name or number, photo, public contact e-mail address, public contact telephone number, GPS location, and other general interest comments about the user provided by the user. All users will be able to see the winner of each box pool, but the total winnings and deposits of each user will be private and not available to other users.

Each user will start, once logged in, on an initial lobby screen to choose an event that the user wants to participate in a box pool. The event can be US football, baseball, basketball, soccer, horse racing, car racing, boxing, and other live sports matches, reality TV shows, etc. Depending on the event, the grid can have any number of boxes and any number of values associated with the boxes. The boxes illustrated can be of any geometric shape, such as a square, circle, oval, rectangular, rhombus, triangular, trapezoid, or any other regular or irregular shape or image such as footballs, baseballs, basketballs, soccer balls, horses, cars, boxing gloves, etc. The box grid and filter for the dollar amount for that particular grid can be displayed. Each user will have visual access to their own private information and to the public information of users.

The times of the events or games are displayed throughout and the users can get push notifications before and during the event. Users can set time deadlines for offers to sell, offers to buy, and offers to trade boxes. All transaction activities must be finalized by the time deadlines set by the user and the time deadlines set by the system control server.

The user display (and optionally an information display, like a television) will provide all necessary information (teams, time, weather, etc.) and event updates. The user display will provide statistics on each and every box and the probabilities of those boxes winning a certain payout before and during the event. These statistics will allow users to make educated decisions on offering to sell and selling, offering to buy and buying, and offering to trade and trading their box or boxes in the marketplace. For example, in a football box pool if a box is initially assigned a value of 9-3, the user display will show general statistics relating to that particular assigned value based on historical data, such as statistics from the last 30 years of football game scores and the percent chance of a box with that assigned value 9-3 ending up as the winning box.

In another non-limiting alternative embodiment of the invention, before or during the event, a user who has not purchased an initial box in the grid for an event can participate in the marketplace by offering to buy and buying a box from another user. Once acquired, the user could then use all the functionalities of offering to buy and buying, offering to sell and selling, and offering to trade and trading as the rest of the users.

Once a box on a grid is purchased by a user, the username or anonymous code name or number of the user appears in the purchased box of the grid. Other users are able to communicate using the communication system of the central server or through other ways, such a telephone calls, text messages, Skype, face-to-face communications, etc., with the user of any particular purchased box of the grid. Users will see the usernames or anonymous code name or number of the other users who purchased boxes in the grid. Users can contact one another by clicking on the user interface link provided, or can separately call, e-mail, or text other users depending upon whether the other user provided this information in their account setup.

The central server is configured to receive event data from an external source and to process the information in real time (or as close to real time as possible). In the example of a football box pool, if the first goal scored by a team during the event is a field goal (value of 3 points), the event information will be communicated to the user display and the grid statistics will be updated in real time to show the updated statistics of percent chance of a user's box ending up a winning box for a particular payout structure. By way of example, the statistics may change for the boxes containing the value "3" to show a higher chance of winning.

Each user will be able to see all of the other users' transaction activity with other users including sales, purchases, and trades. Each box of the grid, when clicked on by a user, displays historical data of transaction activity including sales, purchases, and trades for that particular box for that particular event. Boxes with high levels of transaction activity will be color coded so that users have a visual guide to the boxes receiving (or not receiving) a lot of transaction activity.

The processing of transaction activity including sales, purchases, and trades as well as the winnings will be updated to each user account on an ongoing, real time, basis as soon as the activities are effectuated by the system control server. Communications will be private between users.

In a second non-limiting alternative embodiment of the present invention, the marketplace of transaction activity takes place during the event. In this second non-limiting embodiment of the present invention, at least one processor of a control server is configured to generate a grid of boxes for an event. Users are allowed to purchase a box within a pre-determined time period. This first pre-determined time period can be before the start of the event or during the event. Like in the first non-limiting embodiment, the local server is configured to communicate a user purchase to the central server, and after the purchase time closes, the system control server assigns values to each of the boxes of a grid for the event. However, unlike in the first non-limiting embodiment, in this second non-limiting embodiment, the central server communicates the grid of boxes from the system control server to the local server and the grid of boxes is opened to the marketplace during the event. In non-limiting alternative embodiments, the boxes are opened to the marketplace at the start of the event. In other non-limiting alternative embodiments, the grid of boxes for an event is generated at the start of the event, users purchases boxes shortly after the start of the event, and the marketplace opens shortly thereafter during the event. In other non-limiting alternative embodiments, the grid of boxes for an event is generated before the start of the event, users purchase boxes before the start of the event, and the marketplace opens at the start of the event or shortly thereafter.

In this second non-limiting embodiment of the present invention, users are able to engage in transaction activities including offering to buy and buying, offering to sell and selling, and offering to trade and trading box or boxes during the event. In this second non-limiting alternative embodiment, each user has the option to either refrain from buying, selling, or trading boxes with other users during the event, or can buy, sell, or trade boxes with other users in line with the preference of the particular user for each unique combined assigned value from the beginning of the event to the end of the event. In addition to personal preferences for the unique assigned values of the box, users in this embodiment can use their skills during the particular event to engage in transaction activities in the marketplace depending upon the actions that occur during the particular event, which may change the user's perceived likelihood that any particular unique box will be the winner. Users will be able to strategically offer to sell, offer to buy, and offer to trade boxes with some or all other users by using information learned during the course of the event itself.

In this second non-limiting embodiment of the present invention, the system control server is configured to process the user transaction activities in real time by users, and is configured to process transaction activities in real time between users.

Event information may be displayed on the user display, or on a separate information display along with advertising, instructions, and other information. The central server is also configured to allow users to communicate with each other during the event using a communication system apart from the transaction activity system. In a non-limiting alternative embodiment of the present invention, the marketplace closes at the end of the event. In another non-limiting alternative embodiment of the present invention, the marketplace remains open at the end of the event to allow users to continue to engage in transaction activities with other users in other grids for the same or different events. Sales, purchases, and trades for a grid for a particular event will be reconciled and transmitted to user accounts at the end of the event. For example, the results at the end of the event determine the winner of the entire box pool for that event and payout amounts are determined based on transaction activity during the event.

In a third non-limiting alternative embodiment of the present invention, users can engage in auctioning of one or more boxes. In a non-limiting alternative embodiment of the invention, transaction activity includes offering to sell and selling, offering to buy and buying, offering to trade and trading boxes in whole or in part, auctioning boxes, auction bidding, and any combinations thereof. In another non-limiting alternative embodiment of the invention, auctioning activities are the only transaction activities available to users when the marketplace is open. In other non-limiting alternative embodiments of the invention, auctioning activities when the marketplace is open can take place before and during events.

Auctioning activities include opening an auction of a box, setting auction conditions, making bids, receiving bids, and selling by auction. Auction conditions that can be set by a user to auction the user's box include time parameters and value parameters. For example, a user can auction the user's box with a setting authorizing sale of the box to the highest bidder within a specified time, such as within 5 minutes. In another example, a user can auction the user's box with a setting authorizing sale of the box to the highest bidder provided the bid value exceeds a minimum value set by the user. Optionally, the system will send push notifications to users when auctions are opened and when auctions are about to end. Optionally, the system will determine auction activity time deadlines.

In a fourth non-limiting alternative embodiment of the invention, the processor creates one or more box pools with boxes for one or more events, wherein each created box pool comprises a two dimensional grid of boxes having an x axis and a y axis. A grid having an x axis and y axis is conducive for the designation of columns and rows and conducive to the assignment of unique assigned values to each box within the grid using information assigned to each column and each row of the grid. In alternative non-limiting embodiments of the invention, the grid can comprise any number of columns and any number of rows. In alternative non-limiting embodiments of the invention, the assignment of unique values to each of the boxes of a grid need not be determined by values assigned to columns and rows of a grid having an x axis and a y axis. For example, a two dimensional gird without an x axis and a y axis can be in the shape of a circular dart board with values assigned to each wedge and each separate concentric ring.

In a fifth non-limiting alternative embodiment of the invention, the processor creates one or more box pools with boxes for one or more events, wherein each created box pool comprises a three dimensional grid of boxes having an x axis, a y axis, and a z axis. A grid having an x axis, a y axis, and a z access is conducive for designation of boxes have three variable designations. The three dimensional grid can comprise any number of columns or rows in any of the x axis, y axis and z axis. For example in a US football event, a third variable designation could be selected from a statistic specific to the event, such as the total number of sacks, touchdowns, field goals, interceptions, etc.

In another non-limiting alternative embodiment of the invention, the processor creates one or more box pools with boxes for one or more events, wherein at least one created box pool comprises a two dimensional grid of boxes and at least one created box pool comprises a three dimensional grid of boxes.

In a sixth non-limiting alternative embodiment of the invention, the processor creates one or more box pools with boxes for one or more events and assigns values to the boxes before the boxes are communicated to the user input devices. In this embodiment, users purchase one or more boxes that already have assigned values. Since the values of the boxes are known, users can be selective in purchasing particular boxes with particular unique values for an event. Depending on the skill of the user, the user has the opportunity to purchase one or more boxes with assigned values that may have a preferred likelihood of winning the entire box pool for a particular event.

In this sixth non-limiting alternative embodiment of the invention, the processor creates one or more box pools with boxes for one or more events, assigns values to the boxes, and offers each of the boxes with assigned values for sale to the users at a pre-set price wherein the price is the same for each box in the box pool grid. After receiving user purchases of the one or more boxes with assigned values at the pre-set price per box, the processor then opens user access to the marketplace of boxes. As in other embodiments described herein, users with access to the marketplace are able to engage in transaction activities including offering to sell and selling, offering to buy and buying, offer to trade and trading boxes in whole or in part, auctioning boxes, auction bidding, and any combinations thereof, for in kind consideration (box-for-box, box-for-boxes, or boxes-for-box) and/or cash (box-for-cash, boxes-for-cash, or cash-for-boxes) or in any combination of consideration. In other non-limiting alternative embodiments, the boxes with assigned values at a pre-set price per box can be communicated to users before or during an event. In other non-limiting alternative embodiments, the marketplace of boxes purchased with assigned values at a pre-set price per box can open before or during an event.

In a seventh non-limiting alternative embodiment of the invention, the processor creates one or more box pools with boxes for one or more events, assigns values to the boxes, determines a price of each box within the same grid of boxes with assigned values based on the assigned value of each box, assigns a probability based price to each box within the same grid of boxes with assigned values, and offers each of the boxes with assigned values at the probability based price for sale to users. After receiving user purchases of the one or more boxes with assigned values at the probability based price, the processor then opens user access to the marketplace of boxes.

In this embodiment, users purchase one or more boxes that already have assigned values and pay a price based on the probability of that box winning the entire box pool for the particular event. Since the values of the boxes are known, users can be selective in purchasing particular boxes with particular values for an event. Since the pricing is variable, a user can be selective in purchasing a particular box at a higher price or a different box at a lower price depending upon the difference between the user's perception of the likelihood that the box will win and the difference in price.

As in other embodiments described herein, users with access to the marketplace are able to engage in transaction activities including offering to sell and selling, offering to buy and buying, offer to trade and trading boxes in whole or in part, auctioning boxes, auction bidding, and any combinations thereof, for in kind consideration (box-for-box, box-for-boxes, or boxes-for-box) and/or cash (box-for-cash, boxes-for-cash, or cash-for-boxes) or in any combination of consideration. In other non-limiting alternative embodiments, the boxes with assigned values at a probability based price per box can be communicated to users before or during an event. In other non-limiting alternative embodiments, the marketplace of boxes purchased with assigned values at a probability based price per box can open before or during an event.

In an eighth non-limiting alternative embodiment of the invention, the present invention relates to a box pool marketplace system comprising at least one system control server and at least one central server with memory having instructions stored thereon, wherein the central server is configured to communicate with the at least one system control server and one or more user input devices, and wherein the system control server is configured to (a) initialize one or more box pools for one or more events, (b) process box purchases by users of boxes from one or more box pools and for one or more events, (c) communicate box pool information to users from one or more box pools and for one or more events, (d) receive and process box pool transaction activity between users from one or more box pools and for one or more events, (e) effectuate box pool transactions between users from one or more box pools and from one or more events, and (f) reconcile and transmit net gains and net losses of user transactions to users. In non-limiting alternative embodiments of the invention, the transaction activity comprises one or more of a box offer for sale, a box sale, a box offer to purchase, a box purchase, a box offer to trade, a box trade, a box auction, a box auction bid, each activity in whole or in part, and any combination of such activities. In another non-limiting alternative embodiment of the invention, the central server further comprises a user to user communication system to facilitate transaction activity between users.

In a ninth non-limiting alternative embodiment of the invention, the present invention relates to a kiosk specifically designed for conducting a box pool marketplace. A kiosk is a device that provides information and services on a computer screen, which can be located in an arcade, stadium, mall, casino, or public place. A kiosk for conducting an event box pool marketplace system comprises a user input interface connected to a local server within the kiosk and a user display connected to the local server within the kiosk, wherein the user display provides an interface for the user to view box pool marketplace activities, wherein the local server within the kiosk is configured to communicate with a central server having a system control server, and wherein the system control server is configured to (a) initialize one or more box pools, (b) receive box purchases from user accounts, (c) process transaction activities by and between users, (d) effectuate transactions between user accounts, and (e) reconcile and transmit gains and losses between users in the one or more box pools.

In non-limiting alternative embodiments of the invention, the user input interface of the kiosk is connected physically or wirelessly to the local server within the kiosk. In other non-limiting alternative embodiments, the user input interface of the kiosk is a laptop computer, a tablet computer, a desktop computer, a keyboard, a portable phone, or an electronic watch. In other non-limiting alternative embodiments, the user input interface of the kiosk is a touch sensitive screen. In other non-limiting alternative embodiment, the kiosk further comprises an information display screen for displaying advertisements, instructions, or event information. This information display screen could be populated with information from the central server or from other sources.

In other non-limiting alternative embodiments of the present invention, the kiosk has two or more user input interfaces connected to the local server of the kiosk. In this way, multiple participants can participate on a single kiosk. In other non-limiting alternative embodiments, the locations of the user input interfaces of the multiple participants using the kiosk are displayed using the user display of the kiosk. This would encourage group, in person, participation. For example, a single kiosk with a single user display would have multiple user input interfaces adjacent to one another. In another example, a single kiosk with a single user display would have multiple user input interfaces physically or wirelessly connected to the kiosk.

In other non-limiting alternative embodiments of the invention, the kiosk can be a parking lot display screen, an electronic billboard, a stadium jumbotron, an arcade machine, a casino machine, a shopping mall booth device, a laptop computer, a tablet computer, a desktop computer, a keyboard, a portable phone, and an electronic watch. When, for example, the kiosk is a jumbotron in a stadium, the jumbotron display acts as the user display to everyone in the stadium and the user input interface can be connected to the user display either by being wirelessly connected to the user display or by being physically connected to each participant's seat. When, for example, the kiosk is a parking lot display screen, the display screen acts as the user display and the user input interface can either be physically connected to a post located at each parking spot (like a parking meter) or can be wirelessly connected to each user's user input device.

The present invention is not restricted to the embodiments described, but, on the contrary, covers any modification on form and any alternative form of embodiment that falls within the scope and spirit of the present invention. While there have been described what are believed to be preferred embodiments of the invention, those skilled in the art will recognize that other and further modifications may be made thereto, without departing from the spirit of the present invention.

Specific Example 1

In a box pool game for a sporting event, particularly a professional US football game, the system control server creates a grid of 10 rows and 10 columns for a particular event. Initially, no value is assigned to any row or column of the grid of boxes. The box pool grid is open to users to purchase one or more boxes with no assigned values for the specific game. At a time determined by the system control server, the box pool grid is closed to any user purchases and the boxes of the grid are assigned values based on the assignment of values to the columns and rows of the grid. Then, the box pool grid is communicated from the system control server of the central server to the local serves to open the grid to the marketplace.

In this first specific example, a first user purchases a single box on the initial grid before the grid is open to the marketplace. The purchase price for a single box is, for example, $5. With the purchase of a single box, the first user has a 99 in 100 chance of losing $5 and a 1 in 100 chance of winning $500 (absent any fees). The probability of winning is dependent upon the random assignment of values. In this example, the random assignment number values of 0-9 on the x axis and the y axis and the random assignment of team name values assigned to each column and row. Once the initial boxes have been purchased by users, the box pool grid is closed to users. Then values are assigned to the boxes. Specifically, the numbers 0-9 are assigned randomly to each column, the numbers 0-9 are assigned randomly to each row, and the teams are assigned to each x axis and y axis. After this is done, each box with a unique value is assigned to each box.

In this first specific example, in advance of the start of the football game, the box pool grid of boxes with assigned values is opened to a marketplace of users. In this period of time before the start of the football game, each user can see the assigned values and usernames or user code names of each box on the box pool grid. Each user can offer to sell and sell the user's box to another user in whole or in part, offer to purchase and purchase a box of another user in whole or in part, or offer to trade and trade boxes with another user in whole or in part. Once the unique assigned values of each box is known to users, then each user can use his or her own skills, historical information, and information about the event itself to invest, divest, or enhance the user's chance of winning and odds of gains.

In this first specific example, the box of the first user is assigned the unique value of Row 3 Col 7. In order to win, the team associated with the row will need a final score ending in the number 3 and the team associated with the column will need a final score ending in the number 7. Since historically the numbers 3 and 7 have higher chances of winning than other combinations of numbers, another user may be interested in purchasing the box. The first user can offer to sell the box, or the second user can offer to buy the box. In this first specific example, a second user offers to purchase the first user's box for $20. If the first user accepts the offer and sells the box before the start of the event, then the first user will have a gain of $15 ($20 purchase price minus the initial purchase cost of $5). The second user has also changed the second user's odds of winning the event with the unique combined row and column values of the box purchase from the first user.

Specific Example 2

In a box pool game for a sporting event, particularly a professional US football game, the system control server creates a grid of 10 rows and 10 columns for a particular event. Initially, no value is assigned to any row or column of the grid of boxes. The box pool grid is open to users to purchase one or more boxes with no assign values for the specific game. At a time determined by the system control server, the box pool grid is closed to any user purchases and the boxes of the grid are assigned values based on the assignment of values to the columns and rows of the grid. Then, the grid is communicated from the system control server of the central server to the local serves to open the grid to the marketplace.

In this second specific example, in advance of the start of the football game, the box pool grid of boxes with assigned values is opened to the marketplace. In this period of time before the start of the football game, each user can see the assigned values and usernames or user code names of each box on the box pool grid. Each user can offer to sell and sell the user's box to another user in whole or in part, offer to purchase and purchase a box of another user in whole or in part, or offer to trade and trade boxes with another user in whole or in part. Once the unique assigned values of each box is known to users, then each user can use his or her own skills, historical information, and information about the event itself to invest, divest, or enhance the user's chance of winning and odds of gains.

In this second specific example, the box of the first user is assigned the same unique value of Row 3 Col 7 as in the first specific example. In this second specific example, the second user makes the same offer to purchase the box of the first user for $20. However, in this second specific example, the first user refuses the offer made by the second user in advance of the start of the game.

During the course of the game points are earned by each team. By the middle of the fourth quarter of the game, the score is 3 to 7. At that moment, the first user is extremely optimistic that the first user's box will be the winner of the entire box pool. However, there is still a risk that in the last minutes of the game either team might score, which would change the final score and the first user's box will lose. At the same time, the second user is now very interested in purchasing the first user's box because the chances of the first user's box winning is far greater than before the start of the game.

In this second specific example, in the middle of the fourth quarter the second user now offers the first user $100 to purchase the first user's box. If the first user accepts the offer in the middle of the fourth quarter when the score is 3 to 7, then the first user receives a gain of $95 ($100 proceeds from the box sale minus the initial box purchase price of $5). The second user has also changed the second user's odds of winning the entire box pool (a $500 value) by risking an additional $100 along with the initial box purchase price of $5 with the hopes of winning $395 ($500 potential proceeds from winning the entire box pool minus the box purchase of $100 and minus the initial box purchase price of $5) with the assigned value of the box purchased from the first user.

Specific Example 3

In this third specific example, the box pool is for a soccer event. The system control server creates a grid of 4 rows and 4 columns for this particular event. The x axis and the y axes of the grid of boxes will have values of 0, 1, 2 and 3+. Initially, no value is assigned to any row or column of the grid of boxes. The box pool grid is open to users to purchase one or more boxes with no assigned values for the specific game. At a time determined by the system control server, the box pool grid is closed to any user purchases and the boxes of the grid are assigned values based on the assignment of values to the columns and rows of the grid. Then, the grid is communicated from the system control server of the central server to the local server to open the grid to the marketplace. Transaction activities including offering to sell and selling, offering to purchase and purchase, offering to trade and trading boxes in whole or in part, auctioning boxes, auctioning bidding, and any combinations thereof is then open to the users both before and during the live game.

In this third specific example, the box of the first user is assigned the unique value of Row 1 Col 0. In order to win, the team associated with the row will need a final score ending in the number 1 and the team associated with the column will need a final score ending in the number 0. Since historically the numbers 1 and 0 have higher chances of winning than other combinations of numbers, another user may be interested in purchasing the box. In this third specific example, the first user places the first user's box up for auction with two auction parameters: the box will be sold to the highest bidder within a time limit of 5 minutes and will be sold if the bid value exceeds a minimum value of $10. In this third specific example, six other users bid to purchase the first user's box and at the end of 5 minutes the first user's box is sold to the highest bidder for an amount of $40. In this third specific example, the first user has a gain of $35 ($40 auction proceeds minus the initial purchase cost of $5). The user with the highest bid has also changed their odds of winning the entire box pool with their own initially purchased box plus the unique assigned value of the first user's box purchased at auction. The user with the highest bid has also changed the odds of winning the entire box pool (a $80 value) by risking an additional $40 along with the initial box purchase price of $5 with the hopes of winning $80 with either the assigned value of the box purchased from the first user or their initial box purchase.

Specific Example 4

In this fourth specific example, in a box pool game for a sporting event, particularly a professional US football game, the system control server creates a grid of 10 rows and 10 columns for a particular event. The system control server assigns values to each box of the box pool, assigns a price to each box of the box pool, and opens the box pool grid of boxes with assigned values to users to purchase one or more boxes with assigned values before the start of the event, wherein each box within the same grid of boxes has the same price.

The first user in this fourth specific example, seeing all available boxes with assigned values for purchase selects and purchases a box with the assigned value Row 3 Col 7. Other users purchase other boxes with other assigned values. Each box has the same purchase price. Boxes with assigned values that have high historical likelihood of success in winning the entire box pool, will be purchased before boxes with assigned values that have a low historical likelihood of success in winning the entire box pool. At a time determined by the system control server, the box pool grid is closed to user purchases. Then, the box pool grid is opened to the marketplace.

In this fourth specific example, in advance of the start of the football game, a first user selects a box that the first user perceives is most likely to win the entire box pool. However, during the event, the score becomes 14 to 0. The first user is now pessimistic that the first user's box will win the entire box pool and puts the first user's box up for auction with two auction parameters: the box will be sold to the highest bidder within a 30 minute time limit and with no minimum bid. Other users similarly pessimistic about the likelihood of the first user's box winning the entire box pool do not bid. In this fourth specific example, a second user bids $1 and purchases the first user's box for $1 because the second user perceives during the course of the game that the final score may change and that the first user's box may win. In this fourth specific example, the first user is using the marketplace to reduce the first user's loss. The first user's loss is now $4 instead of $5. The second user is increasing the second user's chance of winning the entire box pool with the purchase by auction of the first user's box for a small investment.

Specific Example 5

In this fifth specific example, the system control server creates two box pools with boxes for two separate events, wherein the separate events are two basketball games. The system control server creates a grid of 100 rows and 100 columns for each particular event. The x axis and y axis will have values of 0 to 100. Initially, no value is assigned to any row or column of either grid. Both grids are opened to users to purchase one or more boxes for each game. At times determined by the system control server, the box pool grids are closed to any user purchases and the boxes of the grid are assigned values based on the assignment of values to the columns and rows of each grid. Then, at times determined by the system control server, both grids are communicated from the system control server of the central server to the local serves to open the grids to the marketplace. Marketplace transaction activities of offering to sell and selling, offering to buy and buying, offering to trade and trading boxes in whole or in part, auctioning boxes, auctioning bidding, and any combinations thereof are open to the users of both box pools before and during the separate basketball games.

Specific Example 6

In this sixth specific example, the box pool game is for a reality television show event. The show is based on two populations of contestants, 7 male contestants and 7 female contestants, living together throughout a television series. At the conclusion of the series, one male contestant and one female contest are declared the winners of the show and the winners together choose a trip to one of three tropical island destinations as the prize for winning the reality television show.

In this sixth specific example, the system control server creates a three dimensional box pool comprising a grid of boxes with an x axis, a y axis, and a z axis. The system control server assigns values to the boxes of the three dimensional box pool grid. The boxes are open for user purchase at the same price per box. In this sixth specific example, the x axis is populated with male contestants, the y axis is populated with female contestants, and the z axis is populated with three tropical destinations. In order to win this three dimensional box pool in this sixth specific example, the user must have the box with an assigned value that identifies the winning male contestant, the winning female contestant, and the winning location.

As in other examples described herein, in this sixth specific example users with access to the marketplace are able to engage in transaction activities including offering to sell and selling, offering to buy and buying, offer to trade and trading boxes in whole or in part, auctioning boxes, auction bidding, and any combinations thereof, for in kind consideration (box-for-box, box-for-boxes, or boxes-for-box) and/ or cash (box-for-cash, boxes-for-cash, or cash-for-boxes) or in any combination of consideration.

Specific Example 7

In this seventh specific example, in a box pool game for an awards show event with 5 male nominees and 5 female nominees for 8 categories of awards, the system control server creates 8 box pools comprising grids of boxes with an x axis and a y axis and a grid of boxes of 5 rows and 5 columns and assigns male nominees and female nominees to each grid for each award category. In this seventh specific example, users who purchased a box from this two dimensional grid with assigned values for an award show event engage in transaction activity with users who purchased a box from the three dimensional grid with assigned values for the reality television show box pool in the sixth specific example.

As in other examples described herein, in this seventh specific example users with access to the marketplace are able to engage in transaction activities including offering to sell and selling, offering to buy and buying, offer to trade and trading boxes in whole or in part, auctioning boxes, auction bidding, and any combinations thereof, for in kind consideration (box-for-box, box-for-boxes, or boxes-for-box) and/or cash (box-for-cash, boxes-for-cash, or cash-for-boxes) or in any combination of consideration.

What is claimed is:

1. A computer-implemented method of conducting a box pool marketplace having at least one processor in communication with one or more user input devices comprising the steps of:

creating one or more box pools with boxes for one or more events that are created by the processor and communicated to the one or more user input devices, wherein each created box pool comprises a grid of boxes with no assigned values;

communicating from the processor to the one or more user input devices at a pre-determined first time the created one or more box pool grids to users to purchase one or more boxes with no assigned values;

receiving by the processor from the one or more user input devices purchases by users of the one or more boxes with no assigned values;

closing by the processor user access to the box pool grid for a specific event at a pre-determined second time;

assigning by the processor of values to the purchased boxes of the closed box pool grid;

opening by the processor user access to the box pool grid of purchased boxes with assigned values at a pre-determined third time, wherein the box pool grid of purchased boxes with assigned values is transmitted to the box pool marketplace for user transaction activity;

receiving and processing by the processor of transaction activity between users, wherein said transaction activity comprises one or more of a box offer for sale, a box sale, a box offer to purchase, a box purchase, a box offer to trade, a box trade, a box auction, a box auction bid, each activity in real time, and any combination of such activities in real time and in whole or in part;

effectuating by the processor of user transactions from the box pool marketplace; and reconciling and transmitting net gains and net losses of user transactions from the box pool marketplace to the users.

2. The method according to claim 1 further comprising the step of storing by the processor a first user's transaction activity of a first box pool in the box pool marketplace to permit said first user to engage in user transaction activity of a second box pool in the box pool marketplace.

3. The method according to claim 1, wherein the pre-determined first time is during the event.

4. The method according to claim 1, wherein the pre-determined third time is before the start of the event.

5. The method according to claim 1, wherein the pre-determined third time is during the event.

6. The method according to claim 1, wherein the transaction activity between users in the box pool marketplace occurs during the event.

7. The method according to claim 1, wherein two or more box pool grids are created by the processor and communicated to the same box pool marketplace; wherein the transaction activity of the same box pool marketplace of two or more box pool grids is received and processed by the processor; and wherein the processed transaction activity of the same box pool marketplace is transmitted to the users from two or more box pool grids.

8. The method according to claim 7, wherein the two or more box pool grids are for the same event.

9. The method according to claim 7, wherein the two or more box pool grids are for different events.

10. The method according to claim 1, wherein the grid of boxes comprises a two dimensional grid of boxes with an x axis and a y axis.

11. The method according to claim 1, wherein receiving and processing by the processor of transaction activity in the box pool marketplace is between a user who purchased one or more boxes and a second user who did not purchase one or more boxes.

12. The method according to claim 1, wherein net gains and net losses of user transactions are transmitted to users at the end of the transaction.

13. The method according to claim 1, wherein net gains and net losses of user transactions are transmitted to users at the end of the event.

14. A computer-implemented method of conducting a box pool marketplace having at least one processor in communication with one or more user input devices comprising the steps of:

creating one or more box pools with boxes for one or more events that are created by the processor and communicated to the one or more user input devices, wherein each created box pool comprises a grid of boxes with no assigned values;

communicating from the processor to the one or more user input devices at a pre-determined first time the created one or more box pool grids to users to purchase one or more boxes with no assigned values;

receiving by the processor from the one or more user input devices purchases by users of the one or more boxes with no assigned values;

closing by the processor user access to the box pool grid for a specific event at a pre-determined second time;

assigning by the processor of values to the purchased boxes of the closed box pool grid;

opening user access to the box pool grid of purchased boxes with assigned values at a pre-determined third time;

receiving and processing by the processor of transaction activity between users;

effectuating by the processor of user transactions; and reconciling and transmitting net gains and net losses of user transactions to the users, wherein net gains and losses of user transactions are transmitted to users at the end of the event.

15. A computer-implemented method of conducting a box pool marketplace having at least one processor in communication with one or more user input devices comprising the steps of:

creating one or more box pools with boxes for one or more events that are created by the processor and communicated to the one or more user input devices, wherein each created box pool comprises a grid of boxes with no assigned values;

communicating from the processor to the one or more user input devices at a pre-determined first time the created one or more box pool grids to users to purchase one or more boxes with no assigned values;

receiving by the processor from the one or more user input devices purchases by users of the one or more boxes with no assigned values;

closing by the processor user access to the box pool grid for a specific event at a pre-determined second time;

assigning by the processor of values to the purchased boxes of the closed box pool grid;

opening user access to the box pool grid of purchased boxes with assigned values at a pre-determined third time;

receiving and processing by the processor of transaction activity between users;

effectuating by the processor of user transactions; and reconciling and transmitting net gains and net losses of user transactions to the users, wherein receiving and processing by the processor of transaction activity is between a user who purchased one or more boxes with no assigned value and a second user who did not purchase one or more boxes with no assigned value.

16. A computer-implemented method of conducting a box pool marketplace having at least one processor in communication with one or more user input devices comprising the steps of:

creating one or more box pools with boxes for one or more events that are created by the processor and communicated to the one or more user input devices, wherein each created box pool comprises a grid of boxes with no assigned values;

communicating from the processor to the one or more user input devices at a pre-determined first time the created one or more box pool grids to users to purchase one or more boxes with no assigned values;

receiving by the processor from the one or more user input devices purchases by users of the one or more boxes with no assigned values;

closing by the processor user access to the box pool grid for a specific event at a pre-determined second time;

assigning by the processor of values to the purchased boxes of the closed box pool grid;

opening user access to the box pool grid of purchased boxes with assigned values at a pre-determined third time;

receiving and processing by the processor of transaction activity between users;

effectuating by the processor of user transactions; and reconciling and transmitting net gains and net losses of user transactions to the users, wherein the grid of boxes comprises a three dimensional grid of boxes with an x axis, a y axis, and a z axis.

17. A computer-implemented method of conducting a box pool marketplace having at least one processor in communication with one or more user input devices comprising the steps of:

creating one or more box pools with boxes for one or more events that are created by the processor and communicated to the one or more user input devices, wherein each created box pool comprises a grid of boxes with no assigned values;

communicating from the processor to the one or more user input devices at a pre-determined first time the created one or more box pool grids to users to purchase one or more boxes with no assigned values;

receiving by the processor from the one or more user input devices purchases by users of the one or more boxes with no assigned values;

closing by the processor user access to the box pool grid for a specific event at a pre-determined second time;

assigning by the processor of values to the purchased boxes of the closed box pool grid;

opening user access to the box pool grid of purchased boxes with assigned values at a pre-determined third time;

receiving and processing by the processor of transaction activity between users, wherein users have access to the assigned values of the purchased boxes and have access to user information of each owner of each purchased box;

effectuating by the processor of user transactions; and reconciling and transmitting net gains and net losses of user transactions to the users; wherein the one or more box pools comprising a grid of boxes comprises two or more grids of boxes, wherein at least one grid of boxes is a two dimensional grid of boxes and at least one grid of boxes is a three dimensional grid of boxes.

18. A computer-implemented method of conducting a box pool marketplace having at least one processor in communication with one or more user input devices comprising the steps of:

creating one or more box pools with boxes for one or more events that are created by the processor and communicated to the one or more user input devices, wherein each created box pool comprises a grid of boxes with assigned values, wherein each box with an assigned value is assigned a price and offered for sale to users at the assigned price;

communicating from the processor to the one or more user input devices at a pre-determined first time the created one or more box pool grids to users to purchase one or more boxes with assigned values at the assigned price per box for the event;

receiving by the processor from the one or more input devices purchases by users of the one or more boxes with assigned values at the assigned price per box;

opening by the processor user access to the box pool grid of purchased boxes with assigned values at a pre-determined second time, wherein the box pool grid of purchased boxes with assigned values is transmitted to the box pool marketplace for user transaction activity;

receiving and processing by the processor of transaction activity between users, wherein said transaction activity comprises one or more of a box offer for sale, a box sale, a box offer to purchase, a box purchase, a box offer to trade, a box trade, a box auction, a box auction bid, each activity in real time and in whole or in part, and any combination of such activities in real time;

effectuating by the processor of user transactions from the box pool marketplace; and reconciling and transmitting net gains and net losses of user transactions from the box pool marketplace to the users.

19. The method according to claim 18 further comprising the step of storing by the processor a first user's transaction activity of a first box pool in the box pool marketplace to permit said first user to engage in user transaction activity of a second box pool in the box pool marketplace.

20. The method according to claim 18, wherein the pre-determined first time is during the event.

21. The method according to claim 18, wherein the pre-determined second time is before the start of the event.

22. The method according to claim 18, wherein the pre-determined second time is during the event.

23. The method according to claim 18, wherein the transaction activity between users in the box pool marketplace occurs during the event.

24. The method according to claim 18, wherein the processor assigns the same price to each box within the same grid of boxes with assigned values.

25. The method according to claim 18, wherein the net gains and net losses of user transactions are transmitted to users at the end of the transaction.

26. The method according to claim 18, wherein the net gains and net losses of user transactions are transmitted to users at the end of the event.

27. A computer-implemented method of conducting a box pool marketplace having at least one processor in communication with one or more user input devices comprising the steps of:

creating one or more box pools with boxes for one or more events that are created by the processor and communicated to the one or more user input devices, wherein each created box pool comprises a grid of boxes with assigned values, wherein each box with an assigned value is assigned a price and offered for sale to users at the assigned price;

communicating from the processor to the one or more user input devices at a pre-determined first time the created one or more box pool grids to users to purchase one or more boxes with assigned values at the assigned price per box for the event;

receiving by the processor from the one or more input devices purchases by users of the one or more boxes with assigned values at the assigned price per box;

opening user access to the box pool grid of purchased boxes with assigned values at a pre-determined second time;

receiving and processing by the processor of transaction activity between users, wherein users have access to the assigned values of the purchased boxes;

effectuating by the processor of user transactions; and reconciling and transmitting net gains and net losses of user transactions to the users; wherein the processor determines the price of each box within the same grid of boxes with assigned values based on the assigned value of each box and assigns a probability based price to each box within the same grid of boxes with assigned values.

28. A box pool marketplace system, the system comprising:

at least one system control server; and at least one central server with memory having instructions stored thereon, wherein the central server is configured to communicate with the at least one system control server and one or more user input devices, and wherein the system control server is configured to (a) initialize one or more box pools for one or more events, (b) process box purchases by users of boxes from one or more box pools and for one or more events, (c) communicate box pool information to users from one or more box pools and for one or more events, (d) receive and process box pool marketplace transaction activity between users from one or more box pools and for one or more events, wherein the box pool marketplace transaction activity comprises one or more of a box offer for sale, a box sale, a box offer to purchase, a box purchase, a box offer to trade, a box trade, a box auction, a box auction bid, and any combination of such activities, (e) effectuate box pool marketplace transactions between users from one or more box pools and from one or more events, and (f) reconcile and transmit net gains and net losses of user transactions from the box pool marketplace to users.

29. The system according to claim 28, wherein the transaction activity between users in the box pool marketplace occurs during the event.

30. The system according to claim 28, wherein the central server further comprises a user to user communication system to facilitate box pool marketplace transaction activity between users.

31. The method according to claim 28, wherein the net gains and net losses of user transactions are transmitted to users at the end of the transaction.

32. The method according to claim 28, wherein the net gains and net losses of user transactions are transmitted to users at the end of the event.

33. A kiosk for conducting a box pool marketplace system comprising:

a user input interface connected to a local server within the kiosk; and a user display connected to the local server within the kiosk, wherein the user display provides an interface for the user to view box pool marketplace transaction activities, wherein the local server within the kiosk is configured to communicate with a central server having a system control server, and wherein the system control server is configured to (a) initialize one or more box pools, (b) receive box purchases from user accounts, (c) process box pool marketplace transaction activities by and between users, (d) effectuate box pool marketplace transactions between user accounts, and (e) reconcile and transmit gains and losses between users in the one or more box pools in the box pool marketplace.

34. A kiosk according to claim 33, wherein the user input interface is connected wirelessly to the local server within the kiosk.

35. A kiosk according to claim 33, wherein the user input interface is selected from the group consisting of a laptop computer, a tablet computer, a desktop computer, a keyboard, a portable phone, and an electronic watch.

36. A kiosk according to claim 33, wherein the kiosk is selected from the group consisting of a parking lot display screen, an electronic billboard, a stadium jumbotron, an arcade machine, a casino machine, a shopping mall booth device, a laptop computer, a tablet computer, a desktop computer, a keyboard, a portable phone, and an electronic watch.

37. A kiosk according to claim 33, wherein the kiosk is a stadium jumbotron and the user input interface is connected to one or more users' seats in the stadium.

38. The method according to claim 33, wherein the gains and the losses between users are transmitted to users at the end of the transaction.

39. The method according to claim 33, wherein the gains and the losses between users are transmitted to users at the end of the event.

* * * * *